US006983629B1

(12) United States Patent
Gogel

(10) Patent No.: US 6,983,629 B1
(45) Date of Patent: Jan. 10, 2006

(54) SECURITY DEVICE FOR CONTAINER DOOR STANCHIONS

(76) Inventor: Roy E. Gogel, Suite 2100, #355 2131 Woodruff Rd., Greenville, SC (US) 29607

( * ) Notice: Subject to any disclaimer, the term of this patent is extended or adjusted under 35 U.S.C. 154(b) by 0 days.

(21) Appl. No.: 11/168,939

(22) Filed: Jun. 28, 2005

Related U.S. Application Data

(60) Provisional application No. 60/587,912, filed on Jul. 14, 2004.

(51) Int. Cl.
*E05B 13/08* (2006.01)

(52) U.S. Cl. ..... 70/14; 70/56; 70/200; 70/212; 292/258; 292/259 R; 292/288; 292/298; 292/DIG. 32

(58) Field of Classification Search ..... 70/2, 70/6, 129, DIG. 43, DIG. 56, 14, 54–56, 70/199, 200, 211, 212; 292/258, 259 R, 292/289, 297, 288, 298, 148, 205, 218, DIG. 32
See application file for complete search history.

(56) References Cited

U.S. PATENT DOCUMENTS 3,475,929 A * 11/1969 Weingart ..... 70/14
3,664,164 A * 5/1972 Zaidener ..... 70/202
4,003,227 A * 1/1977 Casey ..... 70/14
4,389,862 A * 6/1983 Hastings ..... 70/2
4,617,810 A * 10/1986 Fish et al. ..... 70/14
4,669,934 A * 6/1987 Wisecarver ..... 410/151
4,958,867 A * 9/1990 Champagne ..... 292/259 R
5,145,222 A * 9/1992 Meyer ..... 292/258
5,284,036 A * 2/1994 Rosenbaum ..... 70/14
D351,984 S * 11/1994 Victor ..... D8/331
5,953,941 A * 9/1999 Freund ..... 70/199
5,984,387 A * 11/1999 Zeller ..... 292/296
6,331,022 B1 * 12/2001 Liroff ..... 292/307 R
6,591,641 B1 * 7/2003 Cann ..... 70/14
6,668,601 B1 * 12/2003 Reddick ..... 70/56
6,823,701 B1 * 11/2004 Gogel ..... 70/32
6,834,896 B2 * 12/2004 Smith ..... 292/259 R
6,915,670 B2 * 7/2005 Gogel ..... 70/32
2005/0099018 A1 * 5/2005 Witchey ..... 292/218

* cited by examiner

*Primary Examiner*—Lloyd A. Gall
(74) *Attorney, Agent, or Firm*—Charles L. Schwab; Nexsen Pruet, LLC

(57) ABSTRACT

A portable security device for locking a pair of stanchions of a cargo container which employs a J bar having a hook at one of its ends for engaging one stanchion and notches on its other end which are engageable by a complementary latch on a flip plate pivotally mounted to a housing which includes an elbow providing a pocket for the other stanchion. The J bar extends through aligned opening in side walls of the housing and in front of the other stanchion to lock it in its pocket. A puck lock secured to the housing holds the flip plate latch in engagement with a notch of the J bar.

11 Claims, 3 Drawing Sheets

SECURITY DEVICE FOR CONTAINER DOOR STANCHIONS

RELATED PATENT APPLICATION

Features of the invention disclosed herein are disclosed in U.S. provisional patent application Ser. No. 60/587,912 filed Jul. 14, 2004, for a Security Device for Container Door Stanchions, the benefit of which is claimed.

BACKGROUND OF THE INVENTION

This invention is a device for preventing unauthorized opening of the doors of a cargo container of the type used on truck trailers, storage containers such as those used for ocean-going shipments and construction sites, conex containers such as those used by the military, and the similar type door configurations. Such containers customarily have two doors hinged to laterally opposite sides of the rear of the container on vertical axes and the doors are latched in their closed position by vertical stanchions mounted on the outside of the doors. The stanchions have latching fingers at their tops and bottoms which engage keeper pockets at the top and bottom of the rear of the container when the stanchions are pivoted about their axes. Although various locking devices have been proposed for the handles provided for rotating the stanchions, thieves using bolt cutters, power hack saws and sledgehammers are all too frequently destroying the locking devices.

SUMMARY OF THE INVENTION

The security device of this invention locks the stanchions to one another, thus preventing the doors of the cargo container or van from being opened. This security device is portable; that is, it is not permanently secured to the doors or their stanchions. It includes a J bar with hook at one end for hooking over the stanchion for one door and a housing with an elbow or a curved L bar at one side, which hooks around the stanchion of the other door. The J bar has notches forming one or more saw blade shaped teeth near its other end and when the other end is passed through aligned openings in the housing and beyond the housing and beyond the stanchion of the other door, a pocket is formed with the L bar in which the stanchion is locked. At least one tooth shaped stopper or latch is formed on a flip plate, which in turn is pivotally mounted on the housing for swinging the stopper into and out of engagement with teeth of the J bar. The latch is held in its engagement or locking position by a puck lock whose locking bar engages an opening in a receiver or tab rigidly secured to the housing.

BRIEF DESCRIPTION OF THE DRAWINGS

Two embodiments of the invention are illustrated in the drawings in which.

DETAILED DESCRIPTION OF THE INVENTION

Figure 1:
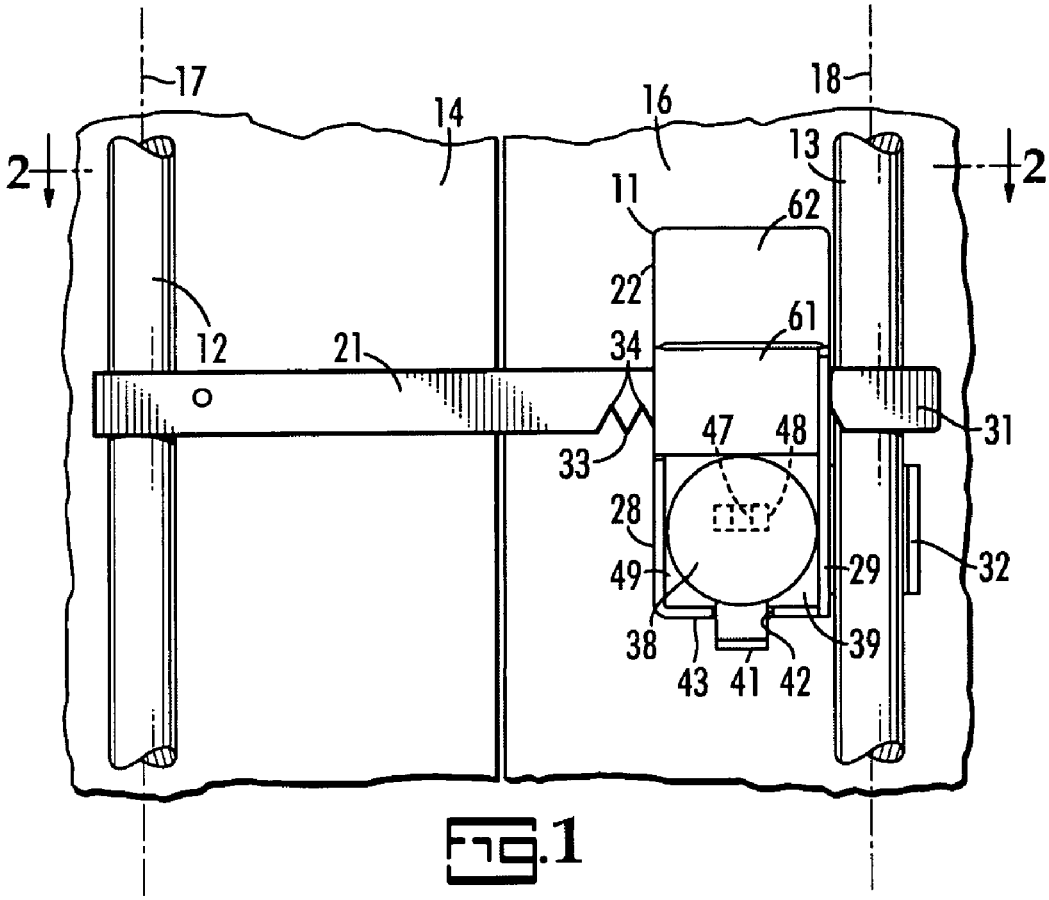
FIG. 1 is a front view of a first embodiment showing the locking device installed on a pair of door stanchions.
Figure 2:
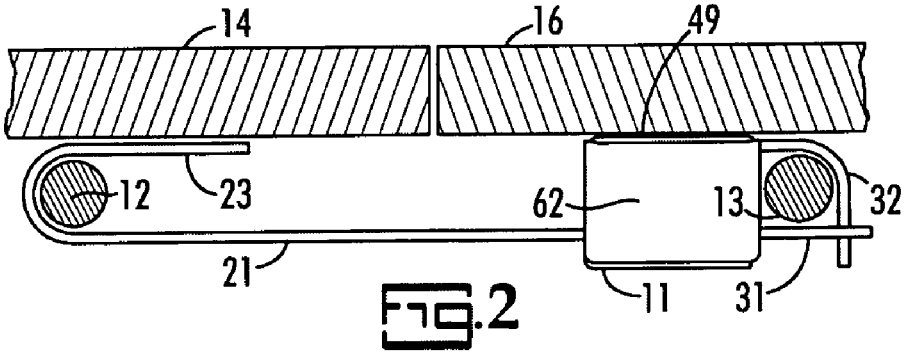
FIG. 2 is a view taken on the line 2—2 in FIG. 1.
Figure 3:
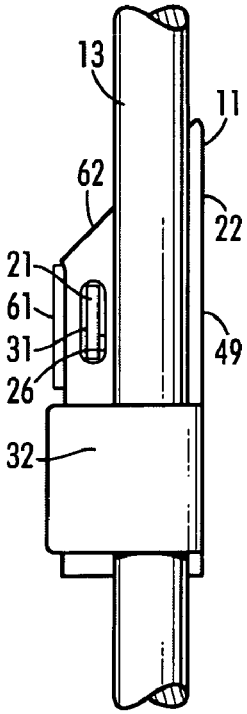
FIG. 3 is a side view of the locking device shown in FIG. 1.
Figure 4:
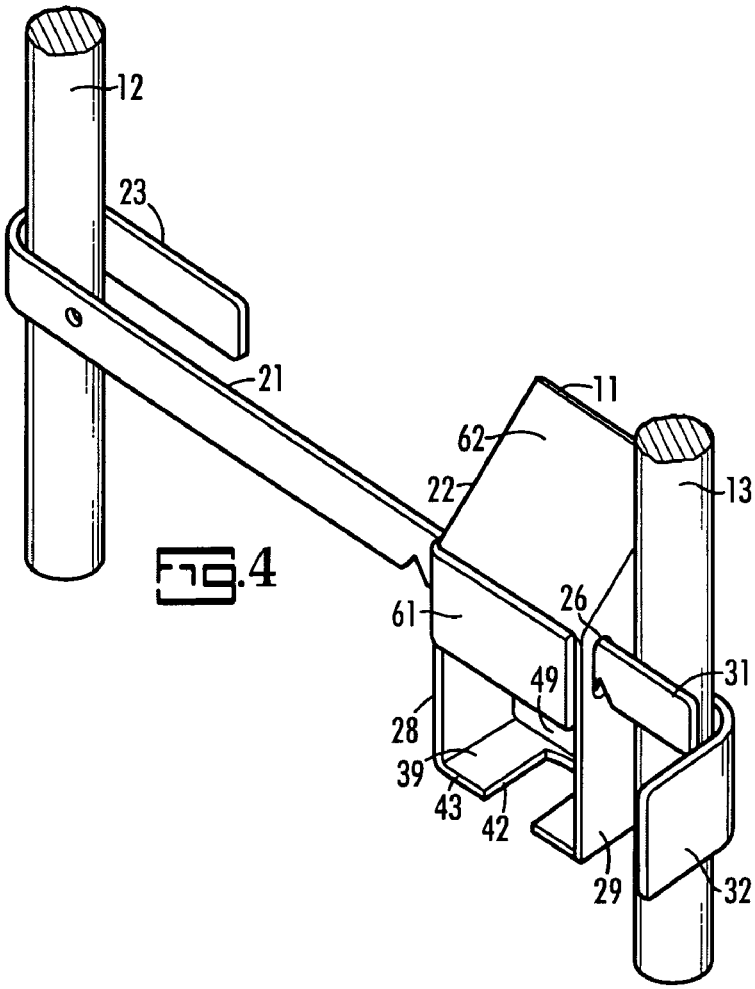
FIG. 4 is a perspective view of the locking device.

FIGS. 1, 2, 3 and 4 illustrate the locking device 11 installed on a pair of vertically extending and laterally spaced stanchions 12, 13 which are rotatably secured to a pair of cargo container doors 14, 16. The parallel stanchions 12, 13 pivot about their laterally spaced axes 17, 18 between locking and unlocking positions. The stanchions have latching fingers, not shown, at their tops and bottoms, which engage keeper pockets when the stanchions are pivoted about their respective axes. The locking device 11 is portable. It attaches only to the stanchions 12, 13. The locking device 11 includes a J bar 21 and a housing 22. The J bar is formed from a hardenable flat plate metal, such as steel, and has a hook 23 at one of its ends, which can be hooked around the stanchion 12. The other end 31 extends through horizontally aligned and vertically extending slots or openings 26, 27 in the laterally spaced vertical side walls 28, 29 of the housing 22, with the end 31 extending laterally beyond the stanchion 13. The end 31 of the J bar 21, together with an L shaped hook or elbow 32 rigidly secured to and extending from the lateral side 29 of the housing 22 and the housing side wall 29 encompass and trap the stanchion 13. The hook 32 is preferably an extension of a back wall 49 of the housing.

Figure 5:
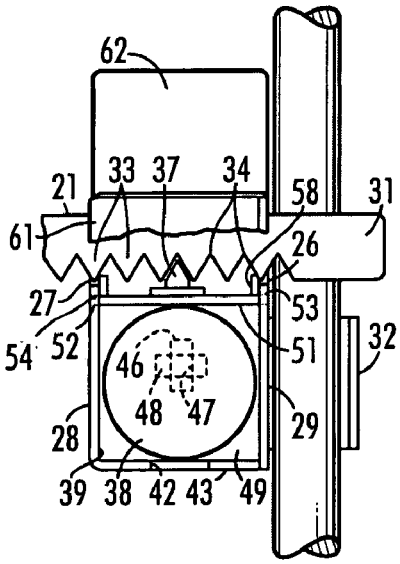
FIG. 5 is a partial front view with a puck lock installed and with parts broken away for illustration purposes.
Figure 6:
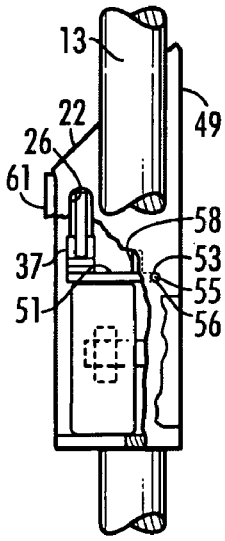
FIG. 6 is a side view of the locking device illustrated in FIG. 5 with parts broken away for illustration purposes.

As shown in FIGS. 5 and 6, the end 31 of the J bar 21 also includes a portion with saw teeth 33. In the installed position shown in FIGS. 5 and 6, a plurality of notches 34 are disposed between the side walls 28, 29, one of which is engaged by an upwardly extending wisdom tooth shaped latch 37 rigidly secured to the front end of a pivotable flip plate 51 held in an engaged locking position, as shown in FIGS. 1, 5 and 6, by a puck lock 38 which is locked in a cavity 39 in the lower part of the housing 22. The cavity is defined by the side walls 28, 29, a horizontal bottom wall 43 and the back wall 49. In FIG. 1, the puck lock 38 is not locked and its key receiving portion 41 extends downwardly through a slot 42 in the bottom wall 43 of the housing 22.

Figure 7:
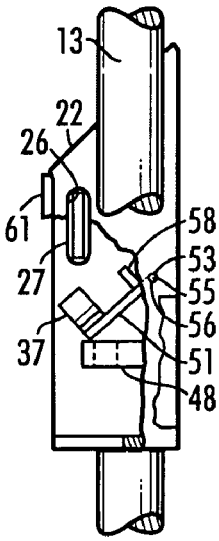
FIG. 7 is a side view similar to FIG. 6 but showing the puck lock removed.

As shown in FIGS. 5 and 6, the puck lock 38 is locked to the housing 22 and in that condition its cylindrical bolt 46 extends through an annular opening 47 in a bolt receiver keeper or tab 48 rigidly secured to and extending forwardly from the back wall 49 of the housing 22. The flip plate 51 includes horizontally aligned trunnions 52, 53 at its rear end pivotally mounted on a laterally extending horizontal axis 55 in coaxial openings 54, 56 in the side walls 28, 29 of the housing 22 allowing the flip plate 51 to be pivoted about the horizontal axis 55 between a nonlocked position shown in FIG. 7 and a locked position shown in FIGS. 5 and 6. When the puck lock 38 is locked to the tab 48, it holds the flip plate 51 in its locked position in which the tooth or latch 37 engages a complementary shaped notch 34 in the J bar 21. The laterally opposite ends of the flip plate 51 have an abutting relationship with the side walls 28, 29. Ears 58 are rigidly secured, as by welding, to the flip plate 51 for additional lateral stability in event the trunnions 52, 53 are struck with blows from one or the other of the lateral opposite side walls 28, 29 of the housing 22. The housing 22 includes a front wall 61 and a roof 62, which slopes upwardly from the front wall 61 to the rear of the housing. The sloping roof 62 helps to deflect hammer blows of thieves attempting to destroy the locking device.

Figure 8:
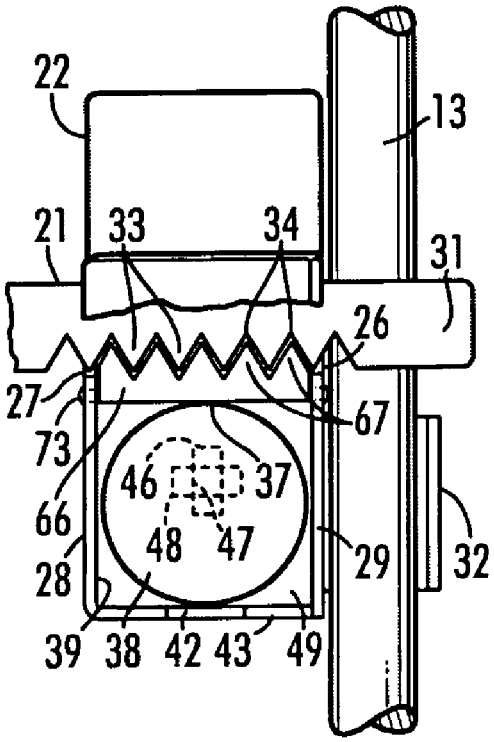
FIG. 8 is a view similar to FIG. 5 showing a second embodiment of the locking device with a multiple tooth flip plate.
Figure 9:
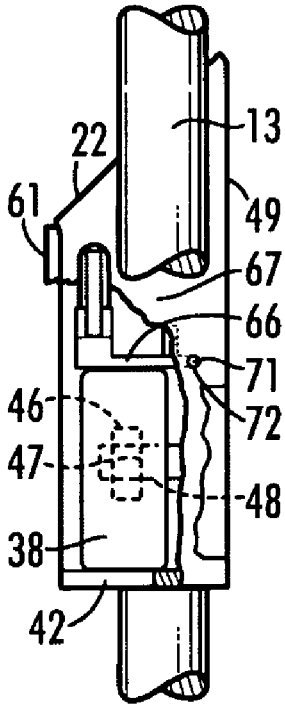
FIG. 9 is a side view of the locking device shown in FIG. 8.

FIGS. 8 and 9 illustrate an embodiment of the locking device in which a flip plate 66 is provided with a plurality of laterally spaced notches forming teeth or saw tooth shaped latches 67 which mesh with the complementary saw tooth shaped notches 34 forming the saw teeth 33 of the J bar 21. The plurality of teeth 67 engaging the teeth 33 of the J bar 21 affords greater resistance to removal of the J bar 21 than a flip plate with a single tooth. The horizontally opposite ends of the flip plate 66 could be in abutting relationship with the interior sides of the side walls 28, 29. FIGS. 8 and 9 show the flip plate 66 pivoted about the horizontal axis 71 of its trunnions 72, 73 to a J bar locking position and it is held in that position by the puck lock bolt 46 engaged in the opening 47 of the tab 48.

This portable security device is easily installed on existing cargo containers and vans and is relatively inexpensive. It is a cost effective deterrent to loss of cargo.

What is claimed is:

1. A security device for locking a pair of vertically extending and laterally spaced parallel container door stanchions with a puck lock having a locking bar, comprising:

a housing having back, bottom and laterally opposite side walls defining a front opening cavity for receiving said puck lock, a pair of horizontally aligned slots formed, respectfully, in said side walls, said slots being vertically elongated, and a bolt receiving tab rigidly secured to and extending forwardly from said back wall including an annular opening for receiving said locking bar of said puck lock, a curved L shaped hook rigidly secured to and extending laterally from said back wall of said housing defining a forwardly open pocket for one of said stanchions beside one of said laterally opposite sides of said housing, a flip plate having a rear end pivotally connected to said side walls on a laterally extending horizontal axis and having a front end to which an upstanding latch is rigidly secured and an elongated J bar having a hook at one of its ends adapted to engage the other of said stanchions and a plurality of horizontally spaced downwardly open notches near its other end, said other end of said J bar extending through said aligned slots in said side walls and in front of said one stanchion in said pocket, said notches being disposed at least in part between said side walls of said housing, said upstanding latch engaging a notch of said J bar when said flip plate is pivoted upwardly about its axis and held there by said puck lock with its locking bar engaged in said annular opening of said tab.

2. The security device of claim 1 wherein the laterally opposite ends of said flip plate are in abutting relation to said laterally opposite side walls of said housing.

3. The security device of claim 1 wherein said housing includes a sloping roof.

4. The security device of claim 1 wherein said flip plate includes a plurality of upstanding latches engageable with a plurality of said notches of said J bar.

5. The security device of claim 4 wherein said notches and latches are tooth shaped in complementary fashion.

6. The security device of claim 1 wherein said latch and notches are tooth shaped.

7. The security device of claim 1 wherein said side walls include aligned openings and said flip plate includes trunnions on its laterally opposite ends pivotally mounted, respectively, in said openings.

8. A security device for locking a pair of vertically extending and laterally spaced parallel container door stanchions with a puck lock having a locking bar and a key receiving portion which extends beyond its annual housing in the unlocked condition of said lock, comprising:

a housing having back, bottom and laterally opposite side walls defining a front opening cavity for receiving said puck lock, a pair of horizontally aligned slots formed, respectfully, in said side walls, said slots being vertically elongated, and a bolt receiving tab rigidly secured to and extending forwardly from said back wall including an annular opening for receiving said locking bar of said puck lock, a curved L shaped hook rigidly secured to and extending laterally from said back wall of said housing defining a forwardly open pocket for one of said stanchions beside one of said laterally opposite sides of said housing, a rearwardly extending recess in said bottom wall adapted to receive said key receiving portion of said puck lock in its unlocked condition, a flip plate having a rear end pivotally connected to said side walls on a laterally extending horizontal axis and having a front end to which an upstanding latch is rigidly secured and an elongated J bar having a hook at one of its ends adapted to engage the other of said stanchions and a plurality of horizontally spaced downwardly open notches near its other end, said other end of said J bar extending through said aligned slots in said side walls and in front of said one stanchion in said pocket, said notches being disposed at least in part between said side walls of said housing, said upstanding latch engaging a notch of said J bar when said flip plate is pivoted upwardly about its axis and held there by said puck lock with its locking bar engaged in said annular opening of said tab.

9. The security device of claim 8 wherein said latch and notches are tooth shaped in a complementary fashion.

10. The security device of claim 9 wherein said flip plate is provided with a plurality of laterally spaced teeth.

11. The security device of claim 8 wherein said side walls include aligned openings and said flip plate includes trunnions on its laterally opposite ends pivotally mounted, respectively, in said openings.

* * * * *